US006000974A

United States Patent [19]

Hotea

[11] Patent Number: 6,000,974

[45] **Date of Patent: *Dec. 14, 1999**

[54] UNIVERSAL CONTACT RECEPTACLE

[75] Inventor: Georghe Hotea, Griesheim, Germany

[73] Assignee: The Whitaker Corporation, Wilmington, Del.

[ * ] Notice: This patent issued on a continued prosecution application filed under 37 CFR 1.53(d), and is subject to the twenty year patent term provisions of 35 U.S.C. 154(a)(2).

[21] Appl. No.: 08/732,502

[22] PCT Filed: May 8, 1995

[86] PCT No.: PCT/IB95/00336

§ 371 Date: Oct. 29, 1996

§ 102(e) Date: Oct. 29, 1996

[87] PCT Pub. No.: WO95/31017

PCT Pub. Date: Nov. 16, 1995

[30] Foreign Application Priority Data

May 10, 1994 [GB] United Kingdom ..... 9409238

[51] Int. Cl.[6] ..... H01R 13/11

[52] U.S. Cl. ..... 439/851; 439/850

[58] Field of Search ..... 439/842, 845, 439/849, 850, 851, 217, 218, 222

[56] References Cited

U.S. PATENT DOCUMENTS

| | | | |
|---|---|---|---|
| 1,146,938 | 6/1915 | Hubbell . | |
| 1,552,262 | 9/1925 | Betz . | |
| 1,602,370 | 10/1926 | Avery . | |
| 3,848,220 | 11/1974 | Frantz . | |
| 4,002,388 | 1/1977 | Menocal . | |
| 4,278,313 | 7/1981 | Blakesley . | |
| 5,023,752 | 6/1991 | Detter et al. . | |
| 5,259,796 | 11/1993 | Yamada et al. | 439/851 |

FOREIGN PATENT DOCUMENTS

| | | | |
|---|---|---|---|
| 0 021 731 | 1/1981 | European Pat. Off. . | |
| 0 709 923 | 5/1996 | European Pat. Off. . | |
| 1040322 | 10/1953 | France | 439/842 |
| 1330870 | 5/1963 | France | 439/850 |
| 8815178 u | 2/1989 | Germany . | |
| 58090 | 8/1946 | Netherlands | 439/851 |
| 960784 | 6/1964 | United Kingdom | 439/850 |

*Primary Examiner*—Gary F. Paumen
*Attorney, Agent, or Firm*—Dricoll A. Nina, Jr.

[57] ABSTRACT

A contact receptacle (4) for an electrical terminal (2) having a plurality of terminal receiving regions (12, 14) defined by a plurality of spring arms (16*a–b*) each of which including a terminal engaging section (20, 21) that corresponds to each of the terminal receiving regions (12, 14) for engaging a tab terminal (8) selectively disposed in one of the regions (12, 14). Furthermore, a terminal mating portion (30) is provided to be received within at least two of the terminal receiving regions (12, 14).

29 Claims, 9 Drawing Sheets

UNIVERSAL CONTACT RECEPTACLE

BACKGROUND OF THE INVENTION

1. Field of the Invention

This invention relates to an electrical contact receptacle, particularly to receptacles that are included as part of a terminal for mating with a tab or pin type terminal.

2. Summary of the Prior Art

In the prior art, there are numerous examples of electrical contact receptacles designed to mate with a tab terminal. Typically, these receptacles comprise at least one pair of oppositely disposed spring arms having contact surfaces thereupon which are adapted to come into contact with opposing sides of the tab terminal. As a tab terminal has a width that is much greater than its thickness these prior art contact receptacles limit the orientation of the tab terminal to two positions, 180° apart.

One particular application for a receptacle terminal configured as an adapter is with respect to an electrical power distribution centre that provides electrical interconnections between electrical and electronic devices and electrical wiring connections in a vehicular electrical system. One example of this type of electrical distribution centre is presented in U.S. Pat. No. 5,023,752. In this patent a pre-stamped metal circuit component includes tab terminals bent transversely thereto for interconnection with the tab terminal of electrical and electronic device, such as fuses and relays. In order to interconnect these tab terminals a double-ended female terminal is located therebetween. The particular double-ended female terminal disclosed requires the tab terminal of the circuit grid to be similarly orientated with the tab terminal from the component. This limitation controls where on the circuit grid the tab terminal must be folded from. In many instances, it may be more desirable to fold the tab terminal from a different location which would result in it being oriented differently than the tab terminal of the device.

In order to solve this problem, it would be desirable to have a contact receptacle capable of receiving the tab terminal of the device in a plurality of orientations, thereby eliminating the necessity of similarly aligning the tabs to be interconnected.

EP-A-0021731 discloses an electrical contact member having one end for engaging a tab terminal in a plurality of orientations. The end includes opposing contact arms that are separated by a slot such that the tab may be electrically engaged by being placed between the opposing contact arms or placed in the slot such that the side edges of the contact arms along the slot contact the tab.

U.S. Pat. No. 3,848,220 discloses a wall socket service outlet for 125 volt or 250 volt service. The wall socket has a connecting member so that the blades of a plug could be oriented in any of two ways, whereby the connecting member includes a contact portion having a channel shape extension over a contact portion for receiving the blade within the channel and between the contact portion for a first portion and between the ends of the channel and the contact portion for a second position transverse to the first position.

SUMMARY OF THE INVENTION

It is an object of this invention to provide a contact receptacle for an electrical terminal for receiving a tab-type terminal in a plurality of orientations.

It is another object of this invention to provide a terminal having a cross-like cross section receivable within the contact receptacle.

It is an object of an embodiment of this invention to provide an adaptor for interconnecting tab-type terminals where at least one of the tabs may be received in the contact receptacle in a plurality of orientations.

It is yet another object of an embodiment of this invention to provide an improved overmould receptacle connector.

It is yet another object to provide an electrical terminal for interconnecting opposing tab terminals incorporated in an electrical distribution box enabling optimization of the structure.

It is an advantage of this invention that the tab type terminal may be received in any one of a number of terminal receiving regions so that the tab terminal maybe optimally oriented relatively independent of the mating contact receptacle. It is another advantage of this invention that a tab, or pin, contact may be created that would be insertable into at least a second of the terminal receiving regions simultaneously, whereby the number of contact points would be increased over a conventional tab terminal, thereby assuring the effective electrical interconnection. It is yet another advantage of this is invention that the contact receptacle may be incorporated into an electrical terminal having a conductor mating end adapted to engage an insulated wire, a circuit trace of a printed circuit board, or any other style of electrical connector, such as a tab terminal or plug terminal. It is still another advantage of this invention that during assembly it is not necessary to worry about proper orientation as multiple acceptable positions are achievable. It is still yet another advantage of this invention that an overmoulded receptacle contact connector may be easily produced by overmoulding a tab terminal and the affixing of a receptacle portion thereto.

BRIEF DESCRIPTION OF THE DRAWINGS

An improved contact suitable for that described above is provided by an advantageously formed electrical terminal for receiving a tab terminal in a plurality of tab terminal receiving regions where the terminal comprises a contact receptacle portion and a conductor mating end with a body portion therebetween, where the contact receptacle portion includes a plurality of cantilevered spring arms extending from the body portion to a free end, the spring arms including a contact surface for engaging the tab terminal; the electrical terminal characterized in that each spring arm includes a pair of legs angularly oriented with respect to each other where adjacent free ends of the legs of different spring arms form the plurality of tab terminal insertion regions.

DETAILED DESCRIPTION OF THE PREFERRED EMBODIMENT

Figure 1:
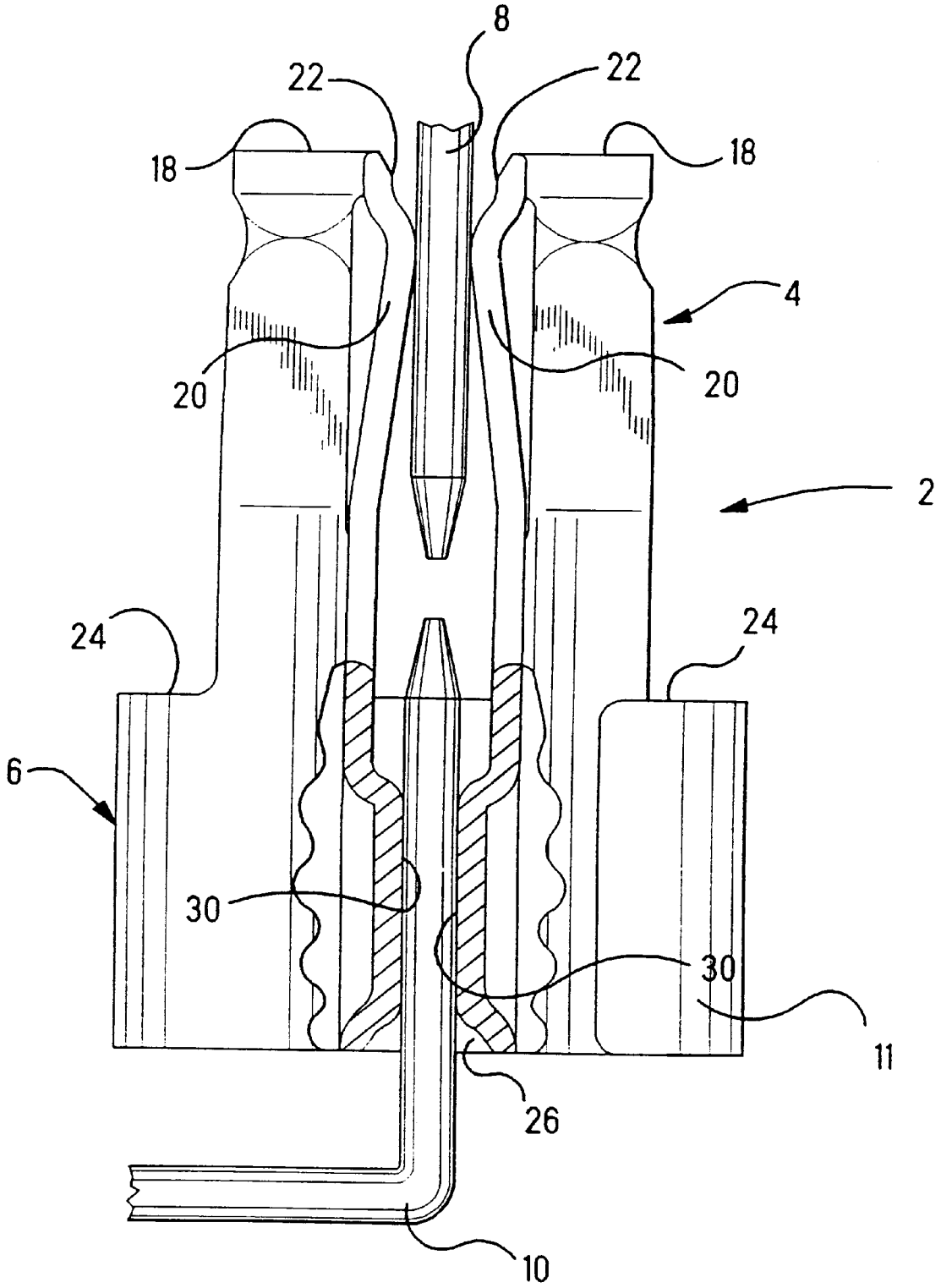
FIG. 1 is a partially broken away side view of an electrical terminal for interconnecting tab terminals.

With reference first to FIG. 1, an electrical terminal is shown at 2. The electrical terminal 2 comprises a contact receptacle 4 at one end and a conductor mating end 6 at the other end. The contact receptacle 4 is constructed to receive a tab terminal 8 in a plurality of orientations, as will be described below. The conductor mating end 6, in this embodiment, is constructed to receive a second tab terminal 10, thereby, in this embodiment forming a terminal that functions as an adapter for interconnecting opposing male terminals 8,10.

In FIG. 1, the tab terminals 8,10 are shown in a similar orientation. It should be noted that the conductor mating end 6 may be configured in any number of ways. For example, an insulation displacement contact may be included for engaging an insulated conductor, a surface mountable foot or pin may be included for mating with a circuit trace of a printed circuit board, the contact mating end 6 may be adapted to mate with other electrical connectors, a crimp termination may be used, or, as illustrated, the conductor mating end 6 may also have multiple receiving regions.

Figure 2:
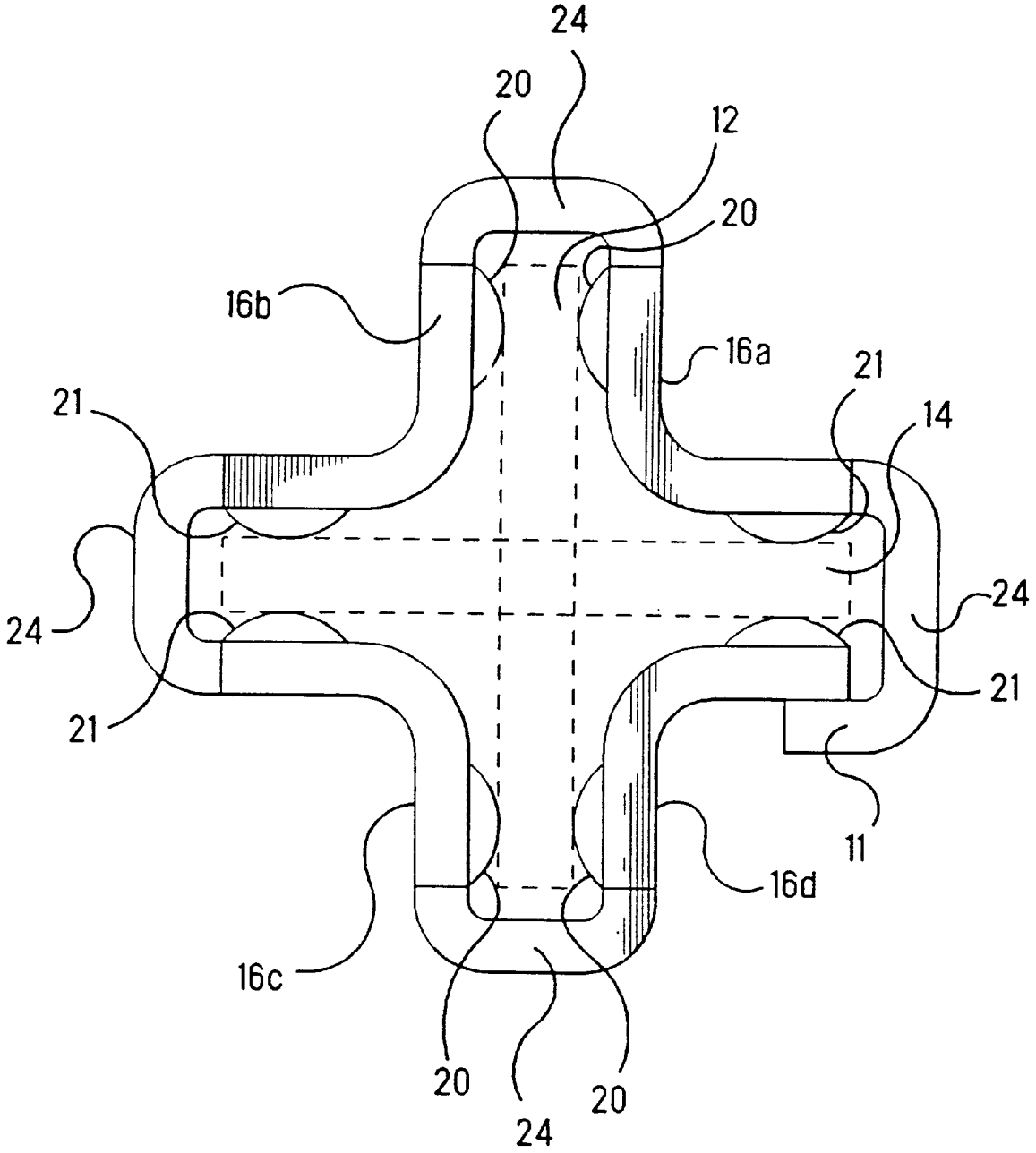
FIG. 2 is a top view of the contact receptacle of the electrical terminal of FIG. 1.

With reference now to FIG. 2, the electrical terminal 2 is folded into a cross-shaped tubular member from one piece of conductive material having the desired electrical and mechanical characteristics. A tab 11 is folded over to retain the integrity of the shape. This tab 11 may be affixed where it overlaps, if necessary, by such processes as laser welding. The contact receptacle 4 defines a first terminal receiving region 12 and a second terminal receiving region 14 that are oriented perpendicular to each other and centrally intersecting. These terminal receiving regions 12,14 are defined by four upstanding L or corner shaped spring members 16*a*, 16*b*,16*c* and 16*d* each of which extend to a free end 18 opposite from the conductor mating end 6. Each of these spring arms 16*a–d* contain an inwardly directed terminal engaging portion 20 that corresponds to the first terminal receiving region 12 and a second inwardly directed terminal engaging portion 21 that corresponds to the second terminal receiving region 14. These portions 20,21 are constructed to make a wiping interference fit with the terminal that is inserted therein for electrical contact. The arms 16*a–b* also include an outwardly directed portion 22 at the free end 18 and corresponding to each engaging portion 20,21 that form a guide or mouth for the insertion of terminal 8 into the respective terminal engaging region 12, 14 of the contact receptacle 4.

The spring arms 16*a–d*, are L-shaped members at the inner portion of the tubular cross shaped terminal 2 that face outward from the centre of the tube which includes the terminal receiving regions 12,14 of the electrical terminal 2. The spring arms 16*a–d* are formed by removing a portion of the material that corresponds to the outer lobes 24 of the cross-shaped tubular terminal 2, thereby providing the independent resilience. It is also apparent that each of the arms of the L-shaped members 16*a–d* are mutually supporting, whereby whichever arm is carrying the contacting surface 20 or 21 is supported by the corresponding arm included within the L-shaped member. If desired, it would be also possible to interconnect the spring arms 16*a–d* at free end 18 by a strap which is integrally formed with the terminal or is separate therefrom. It may also be desirable to provide an outer shell surrounding the spring arms 16*a–d* in a supporting or protective manner.

Figure 3:
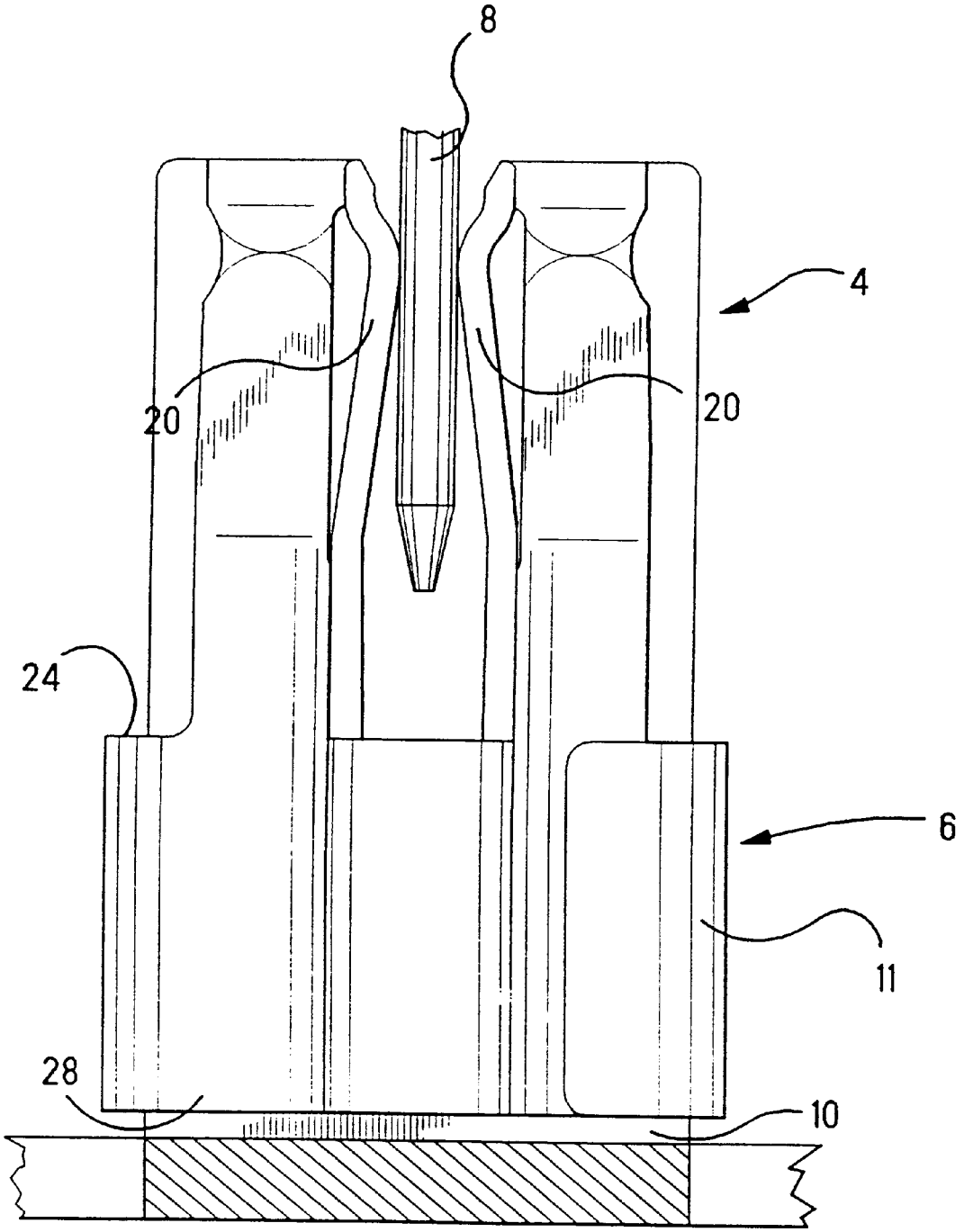
FIG. 3 is a side view of the electrical terminal of FIG. 1 showing mating tab terminals oriented 90° to each other.

The conductor mating end 6, in this embodiment is similarly configured to the contact receptacle 4 in that it includes a pair of conductor receiving regions 26,28 that correspond to the terminal receiving regions 12,14 of the contact receptacle 4. This construction enables the second terminal 10 to also be selectively received in the various regions 26,28. This is best observed by comparing FIGS. 1 and 3. With reference to FIG. 1, the conductor receiving regions 26,28 of the conductor mating end are formed by forming inwardly disposed surfaces 30 along the tubular walls corresponding to extensions of spring arms 16*a–d*, such that a conductor 10 will be received therein in an interference fit.

Figure 4:
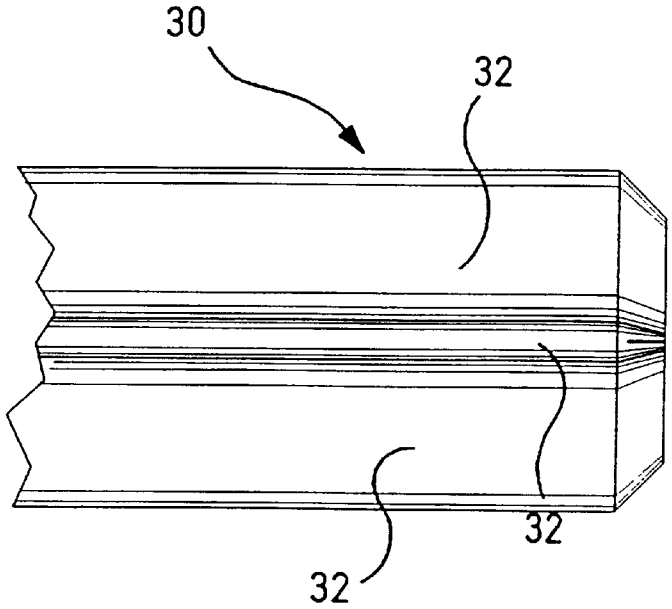
FIG. 4 is a side view of a portion of a terminal configured to be received within the terminal receiving regions of the contact receptacle of FIG. 1.
Figure 5:
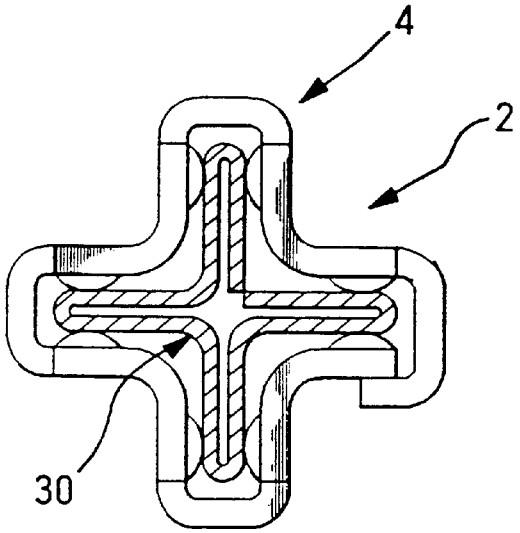
FIG. 5 is an end view of the terminal of FIG. 4.
Figure 6:
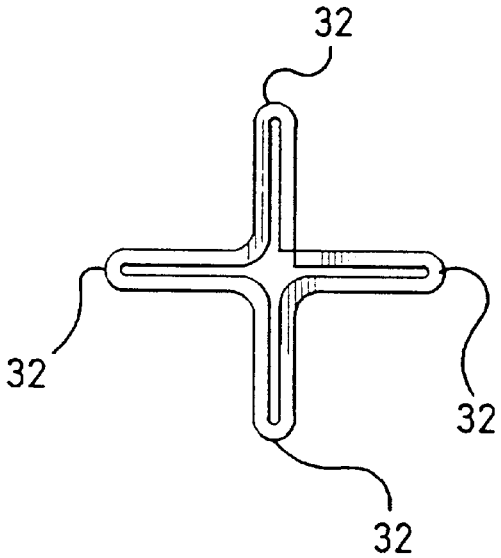
FIG. 6 is a top view of the contact receptacle of FIG. 1 showing a cut away portion of the terminal of FIG. 4 received therein.

With reference now to FIG. 4 and FIG. 5, a mating portion 30 of an electrical terminal (not shown) is constructed to be received within both terminal receiving regions 12,14 simultaneously. The terminal 30 has a cross-shape cross-section having four outstanding ears 32 that are configured to be received within the terminal receiving regions 12,14 of the tubular terminal 2. As each of the four spring arms 16*a–d* include two inwardly directed surfaces 20,21 that are orthogonally disposed to each other, the cross-shaped terminal 30 will be engaged in 8 places, as shown in FIG. 6. The 8 point engagement assures reliable interconnection and the transfer of current.

Figure 7:
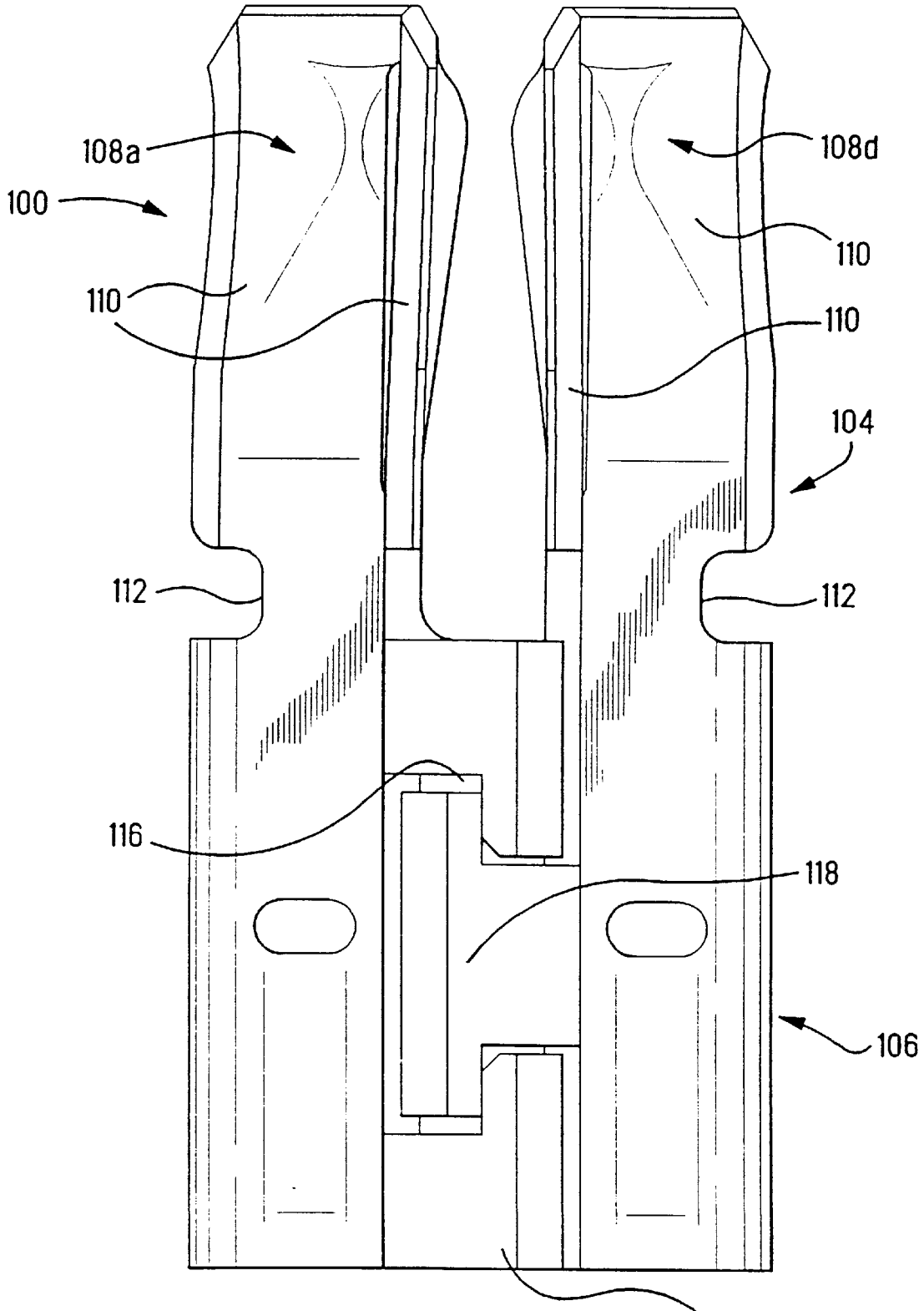
FIG. 7 is a side view of an alternative embodiment of an electrical contact according to the present invention.
Figure 8:
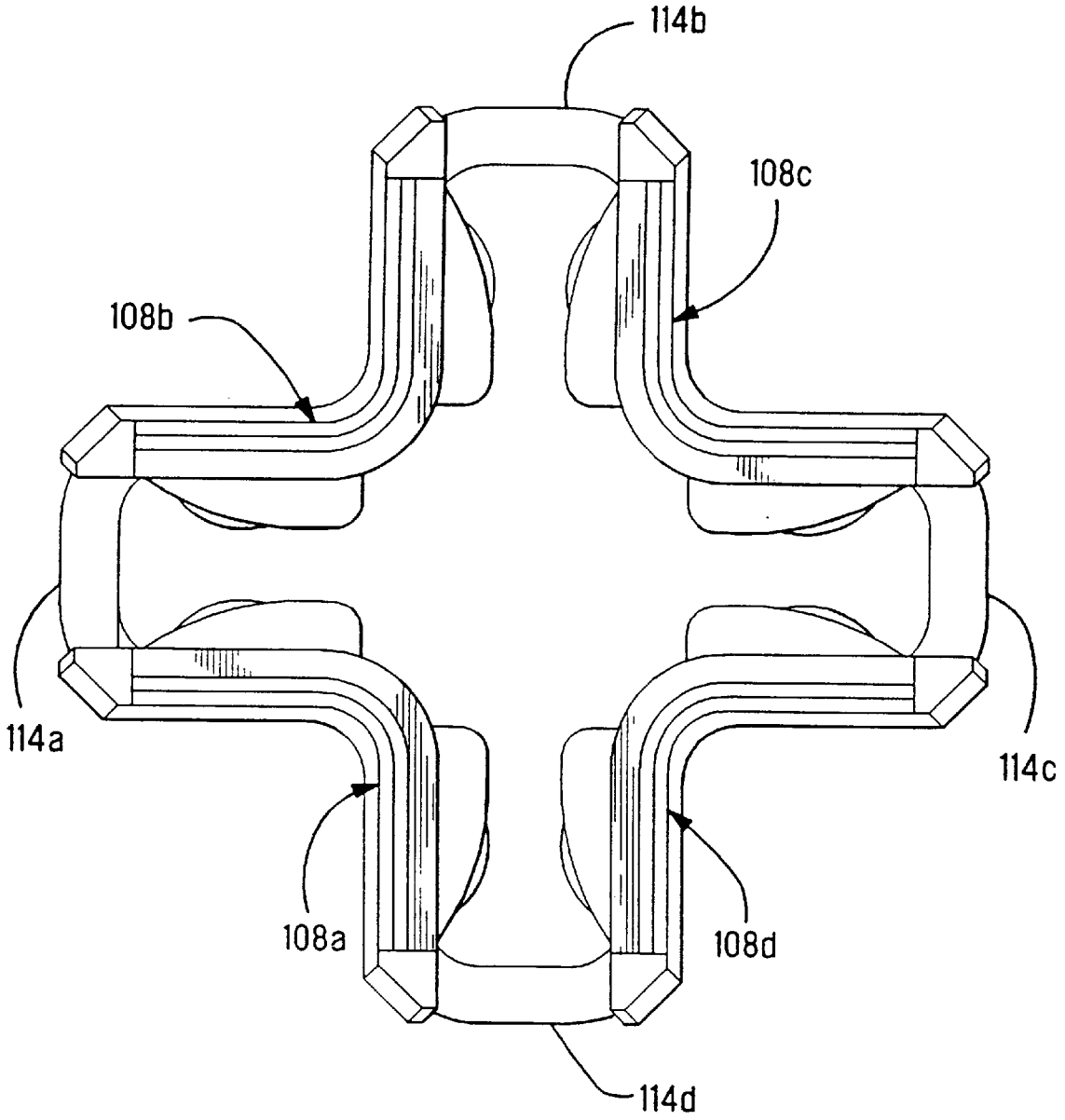
FIG. 8 is a top view of the electrical contact of FIG. 7.
Figure 9:
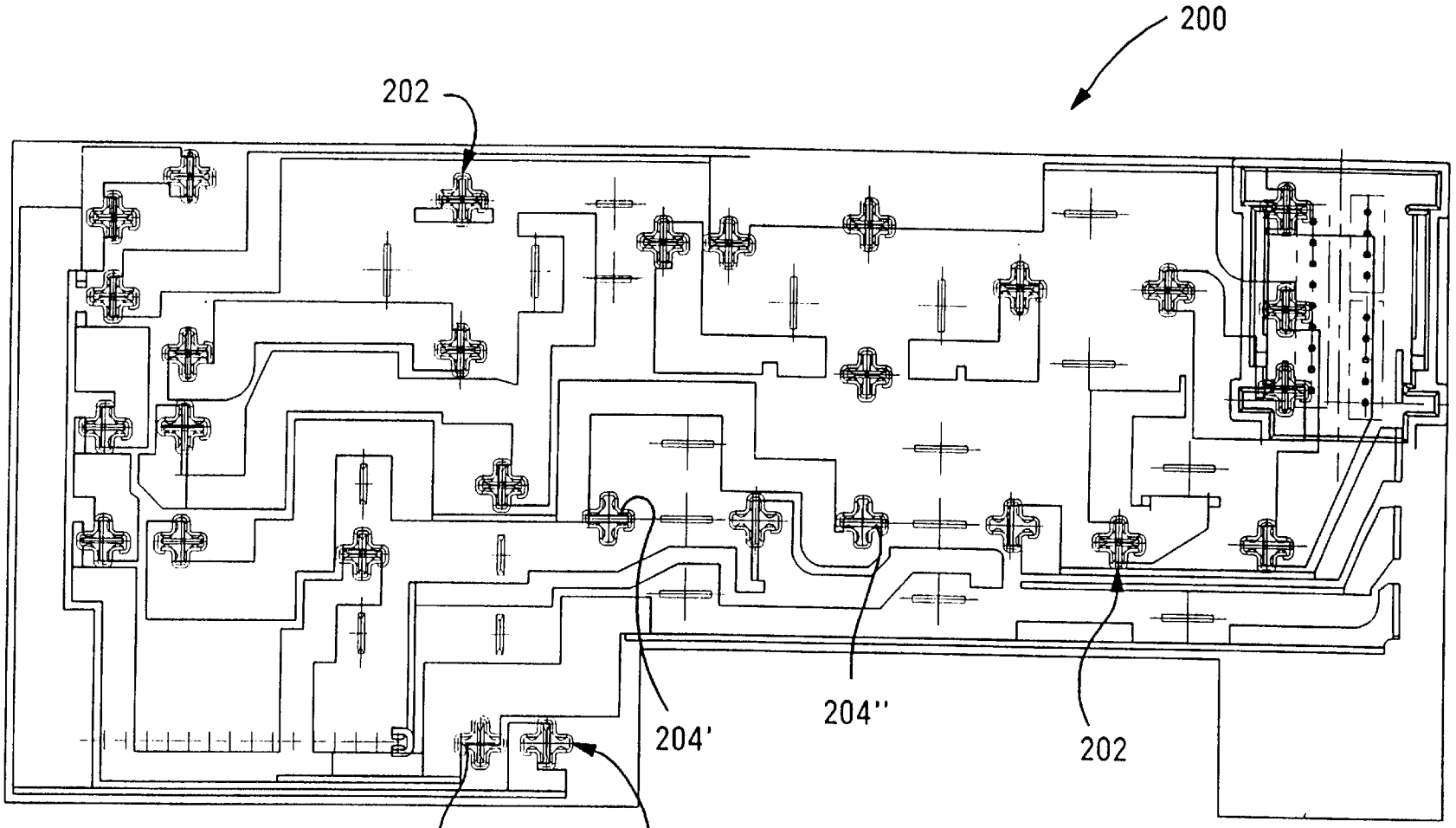
FIG. 9 is a top view of a stamped and formed circuit grid incorporating electrical contacts according to the present invention.

With reference now to FIGS. 7 and 8, an alternative embodiment of the aforedescribed terminal is shown generally at 100, the terminal 100 includes a contact receptacle 104 also having a conductor mating end 106. The contact receptacle 104 includes spring arm members 108*a–d* which are L-shaped as described above such that each of the legs 110 of each spring member 108*a–d* are in a mutually supporting relation and cooperate together at least at their extreme ends of the length of the arm members 108*a–d*. An undercut 112 is provided to enhance compliance. The terminal 100 includes four lobes 114*a–d*, as the terminal 100 is configured to provide two positions. Within one of the lobes 114*d* and opening 116 is included that received a tab 118 in a locking manner that prevents expansion, and ultimately deterioration of the contact force, by the terminal 100 structure. It should be noted while the aforedescribed structures are configured to have two multiple tab terminal receiving positions, another structure may be derived that includes additional positions.

With reference now to FIG. 8, a stamped and formed circuit grid of the type typical for use in vehicle electrical distribution boxes is shown generally at 200. Electrical terminals 202 as described above are shown positioned upon tabs 204 folded out of the plane of the circuit grid 200. The circuit grid 200 includes multiple circuit links 206 from which the tabs 204 are folded. The terminals 202 are especially advantageous as tabs 204' and 204" may be folded in different directions and still provide for receiving tabs of a mating device, such as a fuse, which normally lie in a common plane, thereby providing for efficient use of material and space which provides for a compact and reduced weight component.

Figure 10:
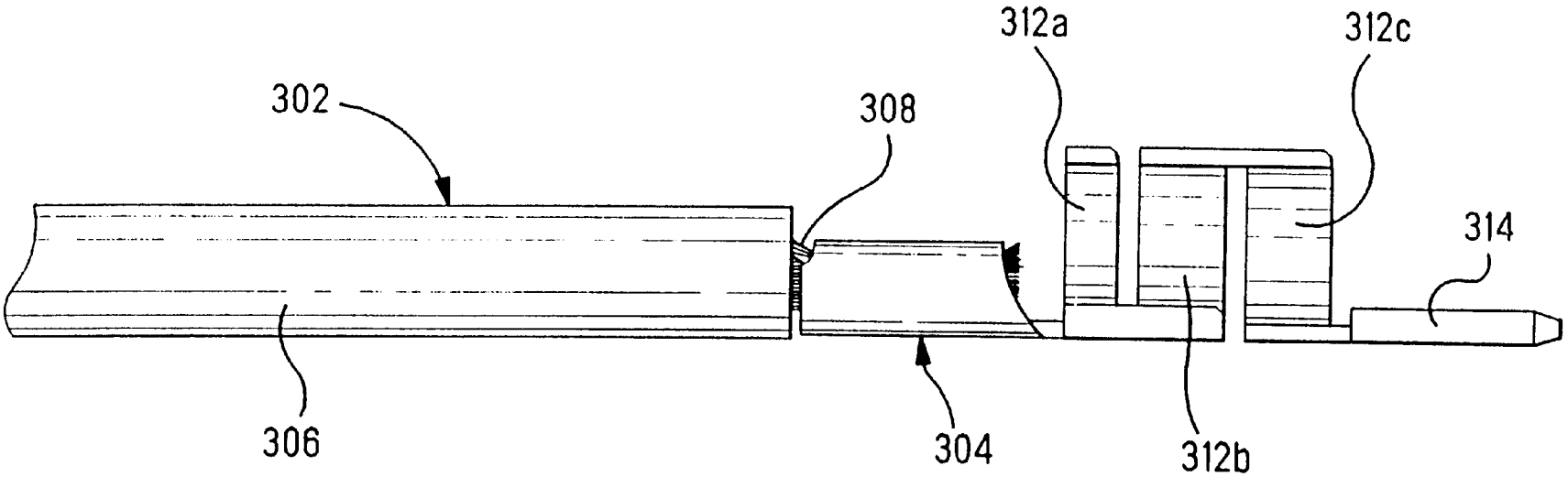
FIG. 10 is a side view of an anti-fretting tab terminal terminating an electrical lead.
Figure 11:
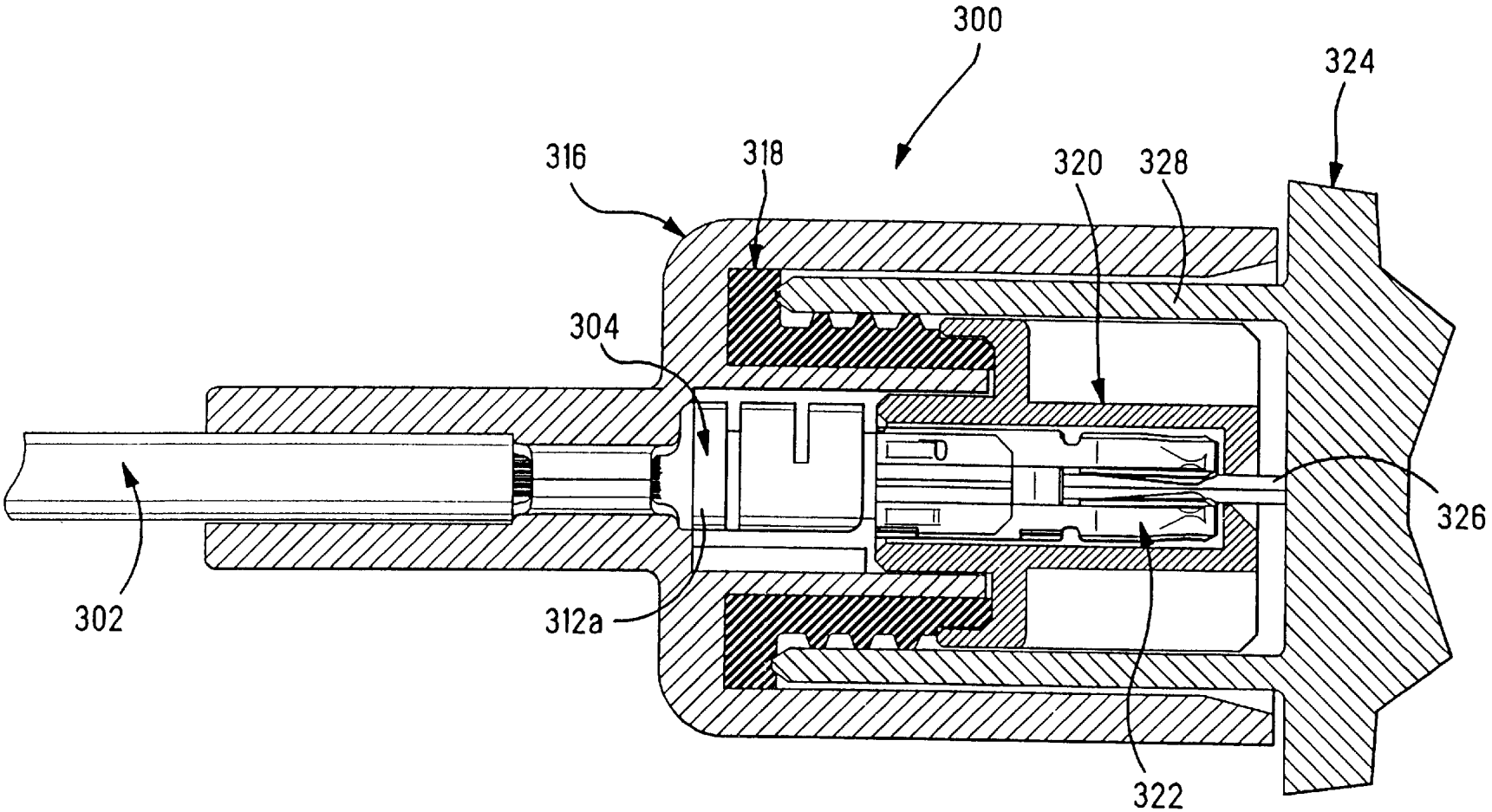
FIG. 11 is a cut-away side view of a waterproof receptacle connector where the connector housing is overmoulded about the terminal and lead of FIG. 10.

With reference now to FIGS. 10 and 11, a sealed electrical connector is shown generally at 300 (FIG. 11). In FIG. 10, an electrical lead 302 is shown terminated by an electrical contact 304. The lead 302 includes an insulative sheath 306 and strands that form a conductive core 308 within the sheath 306. The contact 304 includes a crimp section 310 for mechanically and electrically engaging the core 308 that is formed to extend from a plurality of interconnected band sections 312*a–c* as is known in the art to provide float for reducing fretting corrosion. A tab 314 extends from the band sections 312*a–c* opposite the crimp section 310.

As shown in FIG. 11, a housing 316 is overmoulded about the lead 302 contact 304 structure of FIG. 10 to form the sealed connector 300. The housing 316 is moulded about the lead 302 and the first band 312*a* in a sealed manner, thereby eliminating the need for separate single wire sealing. The housing 316 carries a seal 318 to provide a waterproof connector and a nose portion 320 holds the seal 318 in place. In order to form a receptacle connector, a terminal 322 as described above is affixed to the tab 314 which is easier to form by assembly than by overmoulding a one piece or already assembled receptacle contact. When attached to a complementary component 324, a tab 326 fits within the terminal 322 and a shroud 328 is engaged by the seal 318. The terminal 322 is easily affixed to the tab 314 and the multiple tab receiving regions described above enable greater flexibility.

Advantageously, an electrical terminal is provided that can receive a mating terminal in any one of a plurality of orientations. The terminal reduces assembly costs as polarization is not essential. When incorporated into a circuit grid, tab terminals may be folded to maximize/optimize material usage, thereby producing a component useful in a compact electrical distribution box.

I claim:

1. An electrical terminal for receiving a tab terminal comprising a plurality of tab terminal receiving regions that intersect in a central region where the electrical terminal has a contact receptacle portion and a conductor mating end with a body portion therebetween, where the contact receptacle portion includes the plurality of tab terminal receiving regions defined by spring arms disposed around the central region and extending from the body portion, each tab terminal receiving region having a contact surface for engaging the tab terminal; the electrical terminal being characterized in that the terminal receiving regions are defined by four said spring arms arranged in two pairs with the central region therebetween, each spring arm including a pair of legs angularly oriented with respect to each other, where adjacent distal ends of the legs of different spring arms form the plurality of tab terminal receiving regions, wherein the legs corresponding to a particular terminal receiving region face said region and include the contact surface therealong that is remote from the central region.

2. The electrical terminal of claim 1, further characterized in that the angularly oriented pair of legs of at least one of the spring arms are coupled together in a manner that enhances the stiffness of each leg of said pair.

3. The electrical terminal of claim 2, further characterized in that the angularly oriented pair of legs of at least one of the spring arms are joined together towards the distal ends thereof and separated from one another towards the body portion.

4. The electrical terminal of claim 1, further characterized in that the receptacle portion has four said spring arms each with legs oriented approximately perpendicular to each other, where each leg includes a contact surface, to define the two terminal receiving regions oriented in a cross-like configuration.

5. The electrical terminal of claim 2, further characterized in that opposing legs of different spring arms that define the plurality of tab terminal receiving regions converge towards one another as they extend to the contact surface and then diverge towards the distal ends so that a guide mouth is formed for receiving the tab terminal.

6. The electrical terminal of claim 1, further characterized in that the conductor mating end is configured to receive a second tab terminal.

7. The electrical terminal of claim 6, further characterized in that the conductor mating end is configured to receive the tab terminal in any one of multiple orientations.

8. The electrical terminal of claim 1, further characterized in that the terminal is formed from one piece of folded conductive material.

9. The electrical terminal of claim 8, further characterized in that the contact surfaces of each leg are formed on the same side of the one piece of folded material.

10. The electrical terminal of claim 1, further characterized in that the body portion includes a plurality of lobes corresponding respectively to the plurality of terminal receiving regions, the legs of a particular spring arm extend from adjacent sides of adjacent lobes and the adjacent legs of different spring arms, that in part define one of the terminal receiving regions, extend from opposite sides of a given lobe.

11. The electrical terminal of claim 10, further characterized in that the number of lobes is twice the number of terminal receiving regions.

12. The electrical terminal of claim 10, further characterized in that the lobe is U-shaped where the portion between the opposite sides thereof is removed along the spring arms.

13. The electrical terminal of claim 1, further characterized in that the distal ends of the spring arms are independent of one another.

14. An electrical terminal for receiving a tab terminal in multiple orientations, the electrical terminal comprising a conductor mating end and a contact receptacle portion that includes opposing contact surfaces corresponding to each of the multiple orientations, such that multiple tab receiving regions intersecting in a central region are defined, so that the tab is receivable therebetween, the contact receptacle portion is formed such that the contact surfaces corresponding to two transverse oriented tab receiving regions are formed remote of the central region from a common surface of a material blank used in making the contact receptacle portion.

15. The electrical terminal of claim 14 wherein the material blank used in making the contact receptacle portion of the electrical terminal is folded into a cross-shaped tubular member, the conductor mating end is configured to receive a second tab in multiple orientations, whereby an adapter is formed for interconnecting opposing tab terminals.

16. The electrical terminal of claim 15 wherein the contact surfaces corresponding to adjacent transverse orientations are disposed along arms, the arms of adjacent contact surfaces corresponding to different ones of the adjacent transverse orientations, where adjacent arms corresponding to different tab receiving regions are joined together to define a corner member of the cross-shaped tubular member.

17. The electrical terminal of claim 16 wherein the arms of a corner member are separated from each other along a portion of their length such that the resiliency at the contact surfaces is improved.

18. The electrical terminal of claim 17, wherein the arms each include an undercut therealong to enhance compliance.

19. The electrical terminal of claim 15 wherein the tubular member includes a locking tab that is, folded over to assure integrity of the tubular form.

20. The electrical terminal of claim 19 wherein the locking tab is received in an opening for mechanical locking.

21. An electrical terminal for interconnecting opposing tab terminals, the electrical terminal comprising a cross-shaped tubular member having a contact receptacle end and a conductor mating end; the contact receptacle end having transversely oriented first and second terminal receiving regions that are intersecting in a central region and configured for selectively receiving one of the opposing tabs therein, the contact receptacle end including opposing contact surfaces for engaging the one of the opposing tabs when inserted therein and the contact surfaces corresponding to each of the terminal receiving regions are remote of the central region and formed from a common surface of a material blank used to form the cross-shaped tubular member; and the conductor mating end including a pair of conductor receiving regions that correspond to the terminal receiving regions for selectively receiving the other of the opposing tabs, such that an adapter is formed for interconnecting opposing tabs independent of orientation.

22. The electrical terminal of claim 21, wherein the contact surfaces extend through an outwardly directed portion to define a mouth for receiving the one of the terminals tab.

23. An electrical connector for mating with a mating tab of a complementary component, the connector comprising a connector housing; an electrical contact within the housing, where the electrical contact includes a section for mechanically and electrically engaging a lead and a tab extending oppositely therefrom; an electrical terminal having a conductor engaging end wherein the tab of the contact is received and a contact receptacle portion that includes opposing contact surfaces corresponding to transversely oriented multiple terminal receiving regions intersecting in a central region with contact surfaces for each receiving region disposed in pairs on opposite sides of the central region and remote therefrom wherein the mating tab is receivable therebetween, wherein the contact surfaces corresponding to two of the transverse terminal receiving regions are formed from a common surface of the material used in making the contact receptacle portion.

24. The electrical connector of claim 23, wherein the electrical terminal is folded into a cross-shaped tubular member and the conductor mating end is configured to have similarly oriented multiple tab receiving regions as the contact receptacle portion.

25. The electrical connector of claim 23, wherein the connector housing further includes a nose portion surrounding the electrical terminal.

26. The electrical connector of claim 23, wherein the electrical contact is overmolded in the housing.

27. An electrical terminal for receiving a mating terminal, the electrical terminal comprising a body portion and a mating terminal receptacle portion, the mating terminal receptacle portion including at least four spring arms that extend outward from the body portion to respective distal ends thereby defining at least two mating terminal receiving regions where in two of the mating terminal receiving regions are transversely oriented and intersect in a central region, each of the spring arm is formed of two legs that are each connected to the body portion and co-operate with each other towards the free end such that one leg enhances the stiffness of the other, each leg further includes a contact surface for engaging the mating tab terminals, the four spring arms being arranged so that for one of the mating terminal receiving regions, one of the legs of the four spring arms corresponds to the one mating terminal receiving region and the other leg of each spring arm corresponds to one of the other mating terminal receiving region, wherein the four spring arms are arranged so that the legs corresponding to the one of the mating terminal receiving regions are arranged in two opposing pairs with the opposing pairs separated by the central region.

28. The electrical terminal of claim 27, wherein the legs of a spring arm are joined together at the distal end in an L-shaped manner and a cutout is provided between the free end where the legs are joined together, and the body portion.

29. The electrical terminal of claim 28, wherein the legs of the spring arms diverge outward towards their distal end to define an entry funnel for the mating terminal.

* * * * *